US007766328B2

(12) United States Patent
Noh

(10) Patent No.: US 7,766,328 B2
(45) Date of Patent: Aug. 3, 2010

(54) SHEET FEEDING APPARATUS WITH BUFFER SYSTEM

(75) Inventor: Seung-Kyoon Noh, Seoul (KR)

(73) Assignees: KRDC Co., Ltd., Seoul (KR); Gradco (Japan) Ltd., Tokyo (JP)

( * ) Notice: Subject to any disclaimer, the term of this patent is extended or adjusted under 35 U.S.C. 154(b) by 350 days.

(21) Appl. No.: 11/662,276

(22) PCT Filed: Sep. 9, 2004

(86) PCT No.: PCT/KR2004/002291

§ 371 (c)(1),
(2), (4) Date: Apr. 16, 2007

(87) PCT Pub. No.: WO2006/028306

PCT Pub. Date: Mar. 16, 2006

(65) Prior Publication Data

US 2007/0228645 A1 Oct. 4, 2007

(51) Int. Cl.
*B65H 5/12* (2006.01)

(52) U.S. Cl. ..... 271/275; 270/58.07; 271/82

(58) Field of Classification Search ..... 271/298, 271/300, 303, 314, 82, 308, 312, 277; 270/58.07, 270/58.08

See application file for complete search history.

(56) References Cited

U.S. PATENT DOCUMENTS 4,202,268 A * 5/1980 Becker ..... 101/409
5,662,318 A * 9/1997 Harada et al. ..... 270/58.08
6,070,866 A 6/2000 Wepfer
2005/0285333 A1* 12/2005 Sting et al. ..... 271/277
2006/0151940 A1* 7/2006 Farmer et al. ..... 271/256

FOREIGN PATENT DOCUMENTS

JP 05-188795 A 7/1993
JP 13-151379 A 6/2001
JP 2003-2501 A 1/2003
JP 2003002501 A * 1/2003

* cited by examiner

*Primary Examiner*—Patrick Mackey
*Assistant Examiner*—Gerald W McClain
(74) *Attorney, Agent, or Firm*—Birch, Stewart, Kolasch & Birch, LLP

(57) ABSTRACT

A sheet feeding apparatus with a buffer system is disclosed, in which a sheet feeding drum has a certain rotational speed regardless of the size of the sheet to feed a plurality of sheets to a sheet finisher and eject the sheets after exactly aligning them. The sheet feeding apparatus includes sheet feeding grips 36*a*, 36*b*, 36*c* and 36*d* provided on the outside of a sheet feeding drum 105 at certain intervals, and a sheet feeding grip controller (cam) 42 allowing the sheet feeding grips to selectively grip the sheets moving through the outside of the sheet feeding drum 105. The sheets gripped by the sheet feeding grips are buffered by the end fence and are ejected to a sheet finisher through a sheet ejection path when the end fence is opened. The sheet feeding drum 105 includes a plurality of support rings 33*a*, 33*b*, 33*c*, and 33*d* arranged at certain intervals, sheet feeding rollers 34*a*, 34*b*, 34*c* and 34*d* respectively formed among the support rings, and a central shaft 35 fixing the support rings and the rollers, the sheet feeding grips being provided in the support rings.

7 Claims, 18 Drawing Sheets

SHEET FEEDING APPARATUS WITH BUFFER SYSTEM

TECHNICAL FIELD

The present invention relates to a sheet feeding apparatus that feeds sheets ejected from an image forming apparatus such as a printer and a copier to a sheet finisher such as a stapler and a binder, and more particularly to a sheet feeding apparatus with a buffer system, in which sheets ejected from an image forming apparatus are exactly aligned with a certain time period regardless of processing speed of a sheet finisher.

BACKGROUND ART

A related art sheet feeding apparatus is disclosed in the U.S. Pat. No. 6,283,470.

The related art sheet feeding apparatus will be described with reference to FIG. 1 to FIG. 3.

The related art sheet feeding apparatus 3 serves to feed sheets ejected from an image forming apparatus 1 such as a printer and a copier to a sheet finisher 2 or ejects the sheets to an ejection tray 4 if there is no finishing step. The sheets finished by the sheet finisher 2 are ejected to the ejection tray 14. The sheet feeding apparatus 3 includes a sheet feeding drum 5, a sheet moving path 6, a plurality of fork flips 10 and 11 provided on the sheet feeding drum 5, and sheet ejection paths 7 and 8 connected with the fork flips. A plurality of rollers in pairs are provided on the sheet moving path and the sheet ejection path. A sensor 31 that senses movement of the sheets is provided on the sheet moving path 6, and a sensor 32 that senses the position of the sheets is provided on the sheet feeding drum 5.

The aforementioned related art sheet feeding apparatus 3 serves to move the sheets along the rotating sheet feeding drum 5 if the sheet P1 is moved from the image forming apparatus 1 through the sheet moving path 6.

Meanwhile, to move the sheets to the sheet finisher 1, the fork flips 10 and 11 work to rotate the sheet P1 along the sheet feeding drum until a predetermined number of sheets are buffered. Once the sheet P2 is moved to the sheet moving path 6 when the sheet P1 is moved along the sheet feeding drum 5, the sheets P2 are moved to the sheet feeding drum 5 in a state that the front end of the sheet P1 is substantially flush with that of the sheet P2 as shown in FIG. 1. Likewise, the sheet P3 is fed to the sheet feeding drum in a state that the front end of the sheet P1 is flush with that of the sheet P2 as shown in FIG. 2. The bundle of the sheets P1, P2, and P3 aligned to be flush with one another are moved to the sheet ejection path 8 under the control of the fork flip 11 as shown in FIG. 3. A bundle of the sheets P1, P2, and P3 are then finished by the sheet finisher 2 and are ejected to the ejection tray 14. To allow the front ends of the sheets P1, P2, and P3 to be flush with one another, the rotational speed of the sheet feeding drum 5 should be controlled appropriately at the time when the sensor 31 senses movement of the sheets so that the front end of the sheets is sensed by the sensor 32.

In the aforementioned related art sheet feeding apparatus 3, the rotational speed of the sheet feeding drum 5 is varied depending on the size of the sheet and the sheets are moved by the rollers provided on the sheet feeding drum 5. In this case, jam or error in aligning the sheets is likely to occur. Particularly, if small sized sheets are moved, the rotational speed of the sheet feeding drum 5 becomes excessively fast. If large sized sheets are moved, it is difficult to buffer the sheets in a state that the sheets are exactly aligned.

DETAILED DESCRIPTION OF THE INVENTION

Technical Problem

The present invention is directed to a sheet feeding apparatus with a buffer system that substantially obviates one or more of the problems due to limitations and disadvantages of the related art.

Accordingly, an object of the present invention is to provide a sheet feeding apparatus with a buffer system, in which a sheet feeding drum has a certain rotational speed regardless of the size of the sheet to feed a plurality of sheets to a sheet finisher and eject the sheets after exactly aligning them.

Technical Solution

To achieve these and other advantages and in accordance with the purpose of the present invention, as embodied and broadly described, a sheet feeding apparatus of the present invention includes sheet feeding grips provided at certain intervals on a plurality of support rings constituting a sheet feeding drum, a cam controlling the operation of the sheet feeding grips, and an end fence temporarily buffering sheets in order, which are moving along the outside of the support rings in a state that they are hung in the sheet feeding grips.

The cam is provided at the outlet position of a sheet moving path, and the end fence is provided at the inlet position of one selected from a plurality of sheet ejection paths. A fork flip is provided in the other sheet ejection paths where the end fence is not provided.

The cam is structured in such a manner that the outer end of the corresponding sheet feeding grip is moved to the sheet feeding drum, i.e., the outside of the support rings when the sheet feeding grip reaches the outlet position of the sheet moving path, and the outer end of the sheet feeding grip returns to the original position in a state that it grips the front end of the sheets when the front end of the sheets moving through the sheet moving path is hung in the outer end of the sheet feeding grip.

When a predetermined number of sheets are set and buffered, the end fence is automatically opened to eject a bundle of the sheets to the sheet ejection path.

If the sheets are sequentially ejected one by one without being buffered, the sheet feeding drum is rotated in a state that the sheet feeding grip and the end fence do not work and the sheets moving along the sheet feeding drum (outside of the support rings) are ejected to the sheet ejection path selected by the fork flip.

Advantageous Effects

In the sheet feeding apparatus with a buffer system of the present invention, the sheet feeding grips 36*a*, 36*b*, 36*c* and 36*d* are provided on the outside of the sheet feeding drum 105 at certain intervals, the cam 42 allowing the sheet feeding grips to selectively grip the sheets moving through the outside of the sheet feeding drum are provided, and the end fence 50 driven by the solenoid is provided so that a predetermined number of sheets moving through the sheet feeding drum are buffered in a state that they are gripped by the sheet feeding grip. Therefore, the sheets can exactly be fed at a certain time period regardless of the operational condition of the sheet finisher.

Further, since the sheets are moved to the position at the rear end of the previously buffered sheets and are buffered in a state that they are gripped by the sheet feeding grip, jam of the sheets does not occur and the buffering order of the sheets is not changed.

Best Mode

Figure 1:
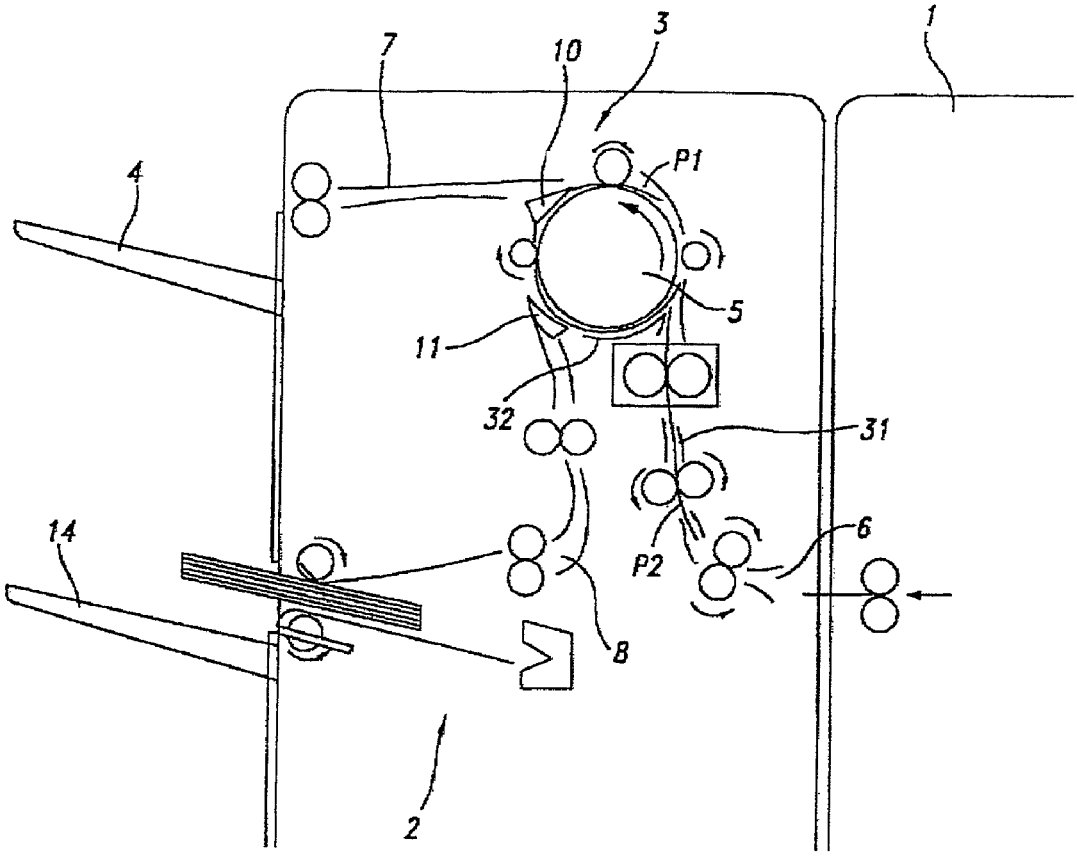
Related Art Fig 1
FIGS. 1 to 3 illustrate a structure of a related art sheet feeding apparatus.
Figure 2:
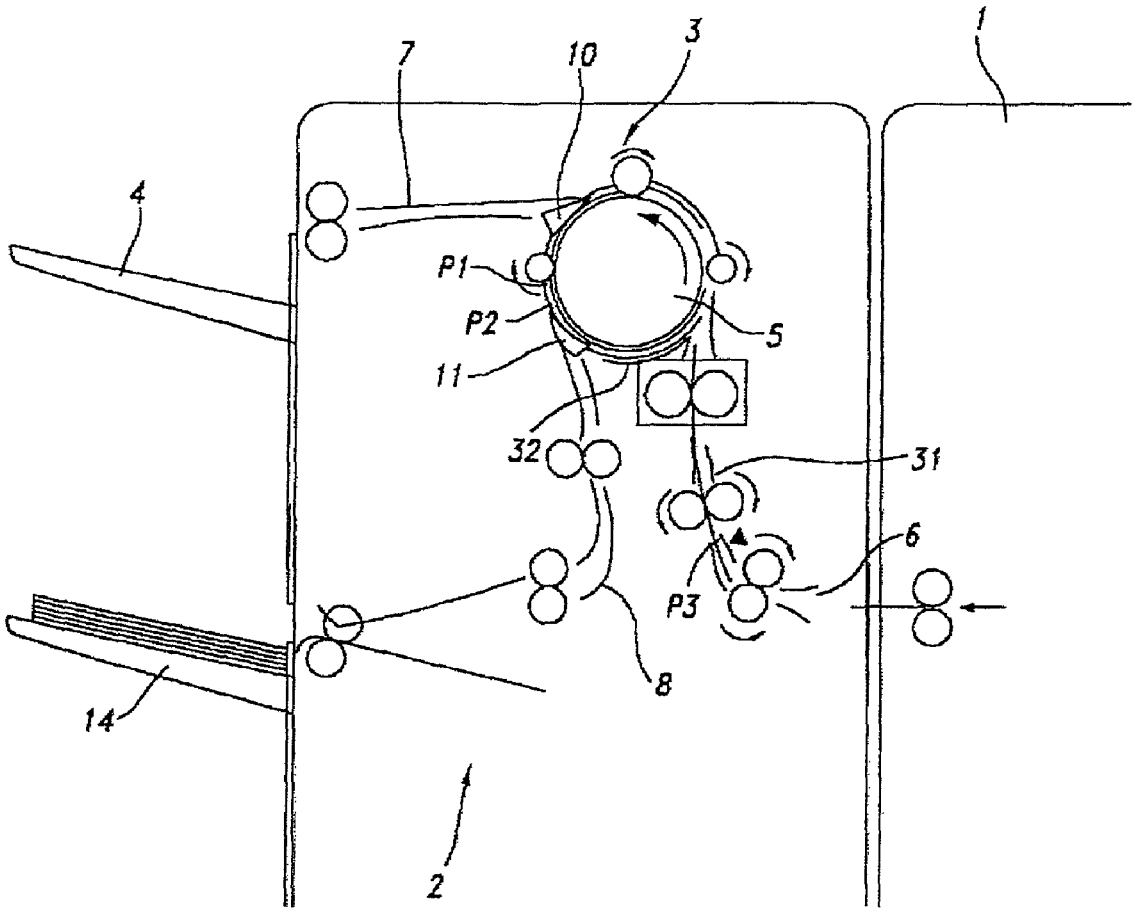
Related Art Fig 2
Figure 3:
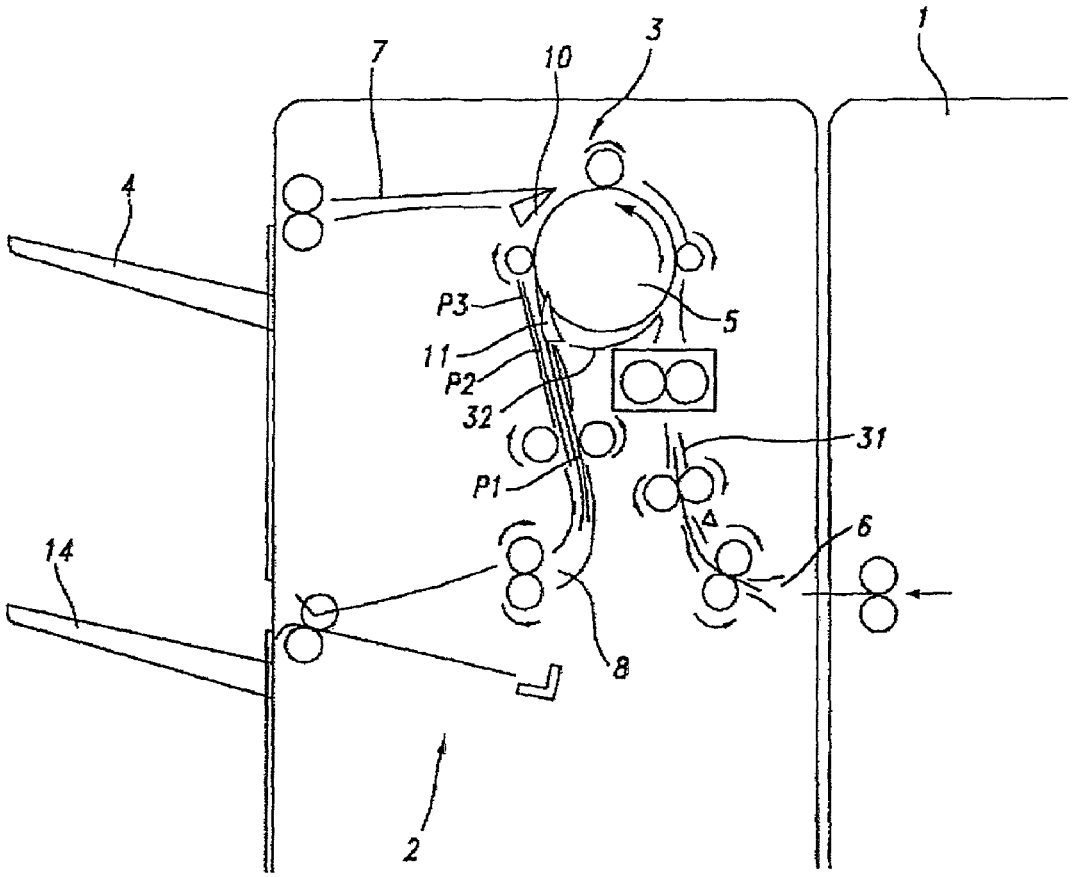
Related Art Fig 3

To achieve these and other advantages and in accordance with the purpose of the present invention, in a sheet feeding apparatus with a buffer system of the present invention including a sheet feeding drum 105 formed to be linked with a sheet moving path 106 and sheet ejection paths 107 and 108 and a buffering means 55 buffering sheets fed through the sheet moving path and the sheet feeding drum to eject the buffered sheets to the sheet ejection path 108, the sheet feeding apparatus includes sheet feeding grips 36*a*, 36*b*, 36*c* and 36*d* provided on the outside of the sheet feeding drum 105 at certain intervals, and a sheet feeding grip controller 42 allowing the sheet feeding grips to selectively grip the sheets moving through the outside of the sheet feeding drum 105.

The buffering means sequentially buffers a predetermined number of sheets among the gripped sheets.

The sheet feeding grips 36*a*, 36*b*, 36*c* and 36*d* are operated at the outlet position of the sheet moving path 106 while the buffering means 55 is operated at the inlet position of the sheet ejection path 108.

The sheet ejection paths are circumferentially provided along the outside of the sheet feeding drum to adjoin the outside of the sheet feeding drum, the buffering means 55 is provided in any one selected from the sheet ejection paths, and a fork flip 110 is provided in the other sheet ejection path 107.

Particularly, the sheet feeding drum 105 includes a plurality of support rings 33*a*, 33*b*, 33*c* and 33*d* arranged at certain intervals, sheet feeding rollers 34*a*, 34*b*, 34*c* and 34*d* respectively formed among the support rings, and a central shaft 35 fixing the support rings and the rollers, the sheet feeding grips being provided in the support rings.

The sheet feeding rollers are provided with idle rollers 37*a*, 37*b*, 37*c* and 37*d*on the outside.

The sheet feeding grips include a first extension 41*a* and a second extension 41*b* provided with a fixed shaft 39 interposed between them to rotatably fix the first and second extensions 41*a* and 41*b* to the support rings of the sheet feeding drum, the first extension is fixed to a flexible shaft 38 disposed between the central shaft 35 and the support rings, and a cam 42 serves as the sheet feeding grip controller and is opened so as to allow the second extension 41*b* to grip the sheets moving through the sheet moving path 106 when the flexible shaft is pushed to a predetermined position of the cam 42.

The end of the second extension is closely adhered to the outer surface of the support rings fixing the second extension and is substantially flush with the outside of the sheet feeding rollers when it grips the sheets.

The first extension includes a spring 44 fixed to the support rings to act tension on the support rings.

The cam includes a positioning controller 43 that can control the pushed position of the flexible shaft, and the positioning controller is rotated at a predetermined angle around the central shaft of the support rings fixed to the cam.

The buffering means includes an end fence 50 controlled by a solenoid 51.

A sheet feeding apparatus according to the present invention will be described with reference to FIGS. 4 to 18.

Figure 4:
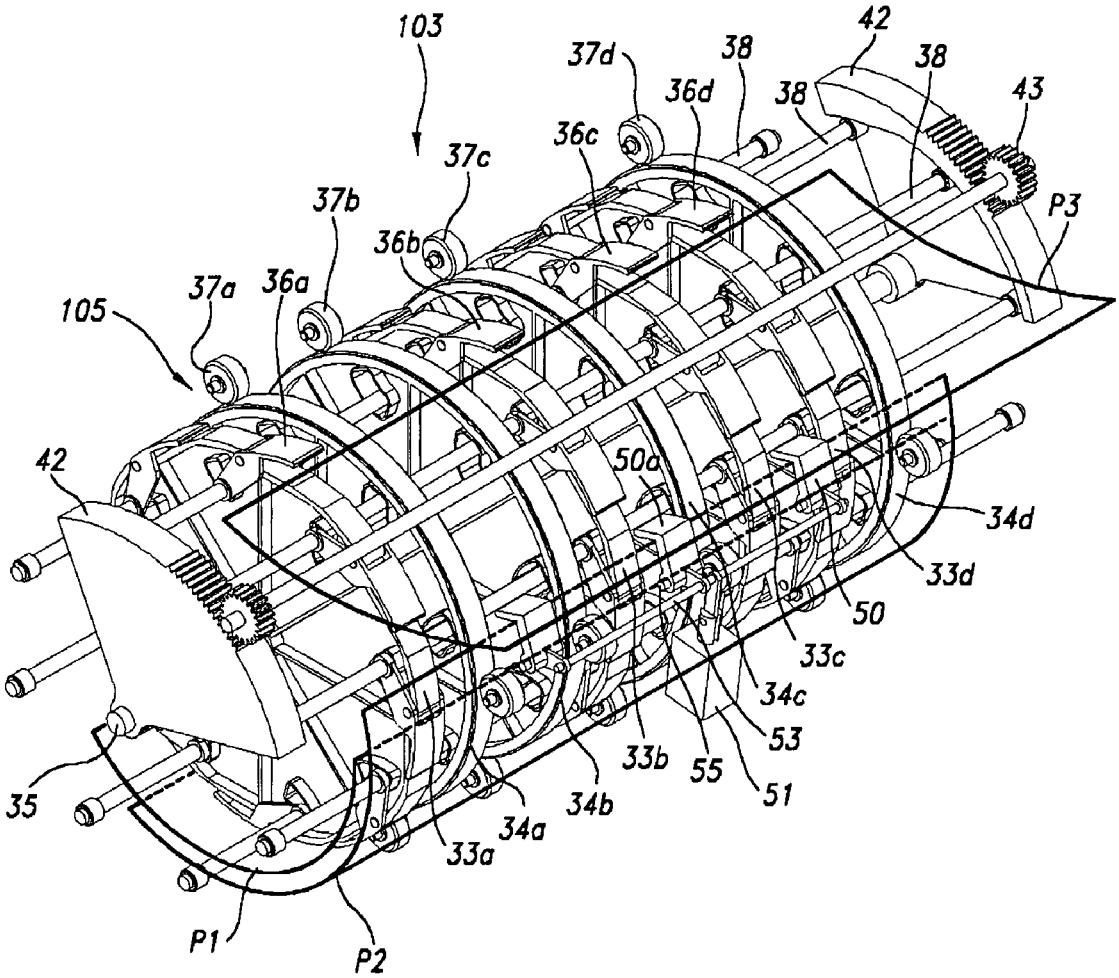
FIG. 4 is a perspective view of a sheet feeding apparatus according to the present invention.
Figure 5:
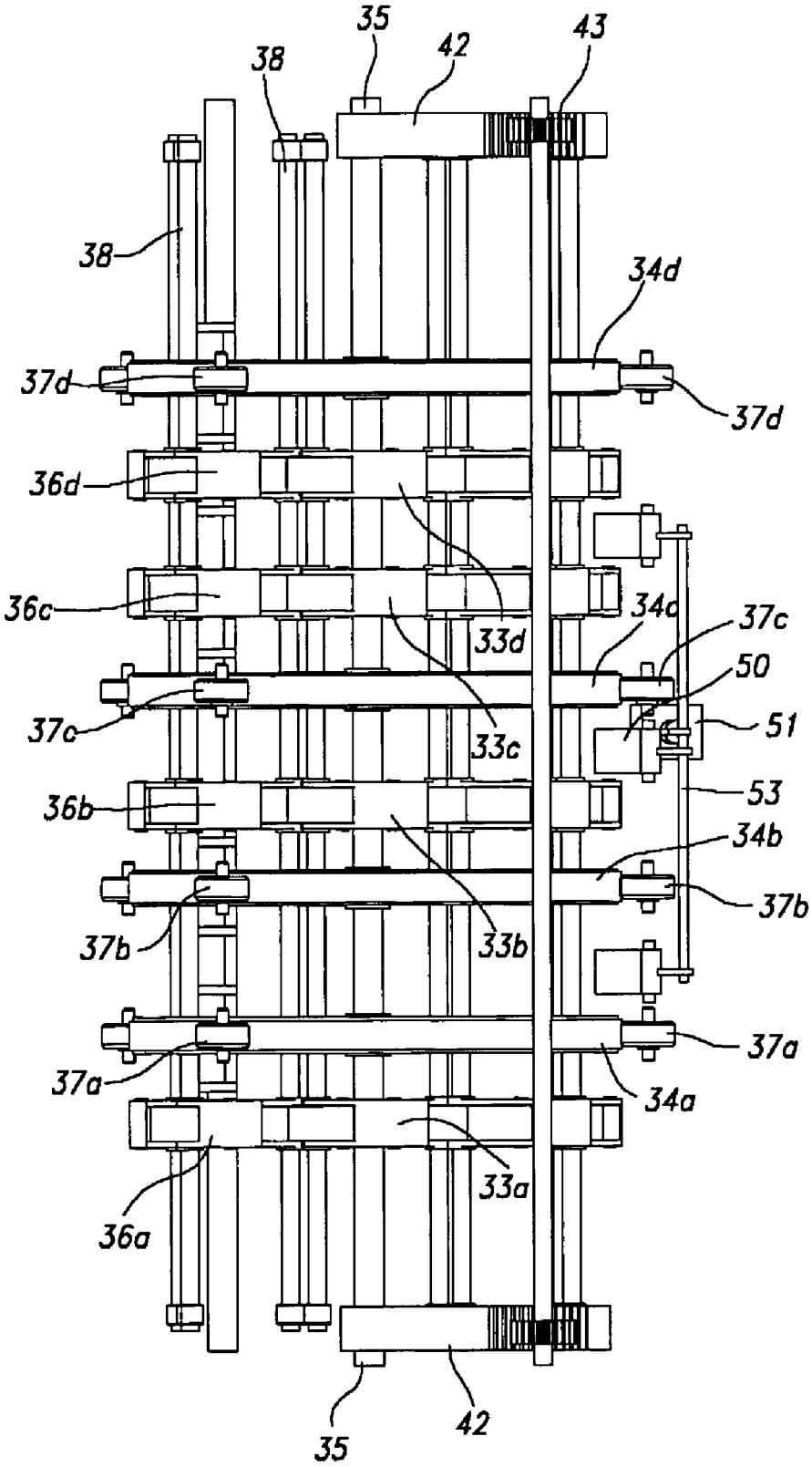
FIG. 5 is a plane view of a sheet feeding apparatus according to the present invention.
Figure 6:
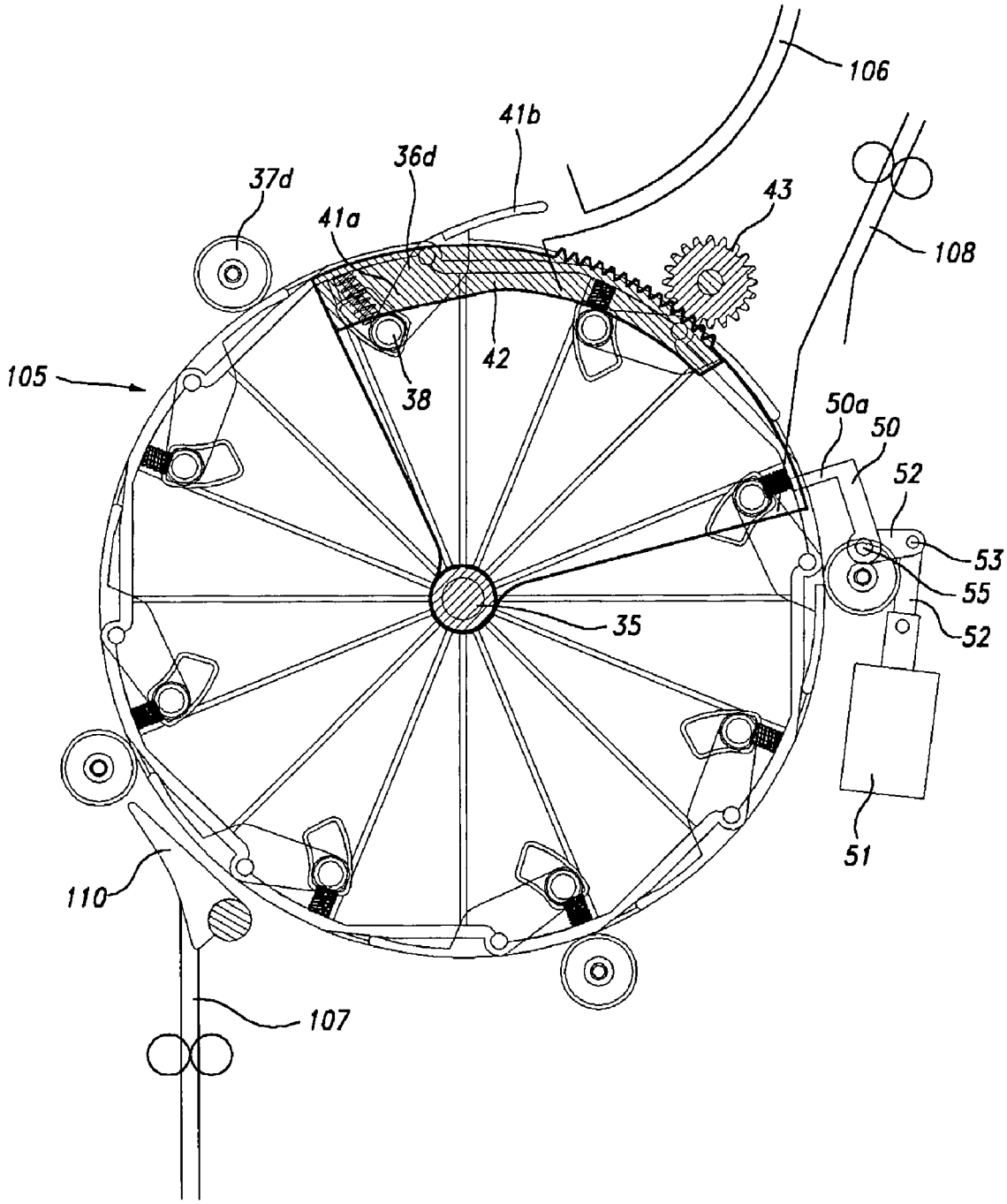
FIG. 6 is a side view of a sheet feeding apparatus according to the present invention.

As will be aware of it from FIGS. 4 and 6, a sheet feeding apparatus 103 of the present invention includes a cylindrical sheet feeding drum 105 formed to be linked with a sheet moving path 106 and a plurality of sheet ejection paths 107 and 108. The sheet feeding drum 105 includes a plurality of support rings 33*a*, 33*b*, 33*c* and 33*d* arranged at certain intervals, sheet feeding rollers 34*a*, 34*b*, 34*c* and 34*d* respectively formed among the support rings, a central shaft 35 fixing the support rings and the respective rollers, and idle rollers 37*a*, 37*b*, 37*c* and 37*d* respectively adjoining the rollers. The sheet feeding drum 105 is rotated around the central shaft 35. The respective support rings constituting the sheet feeding drum are provided with sheet feeding grips 36*a*, 36*b*, 36*c* and 36*d* at certain intervals along the outside of the support rings.

The structure and operation of the sheet feeding grips will be described in more detail with reference to FIG. 7.

Figure 7:
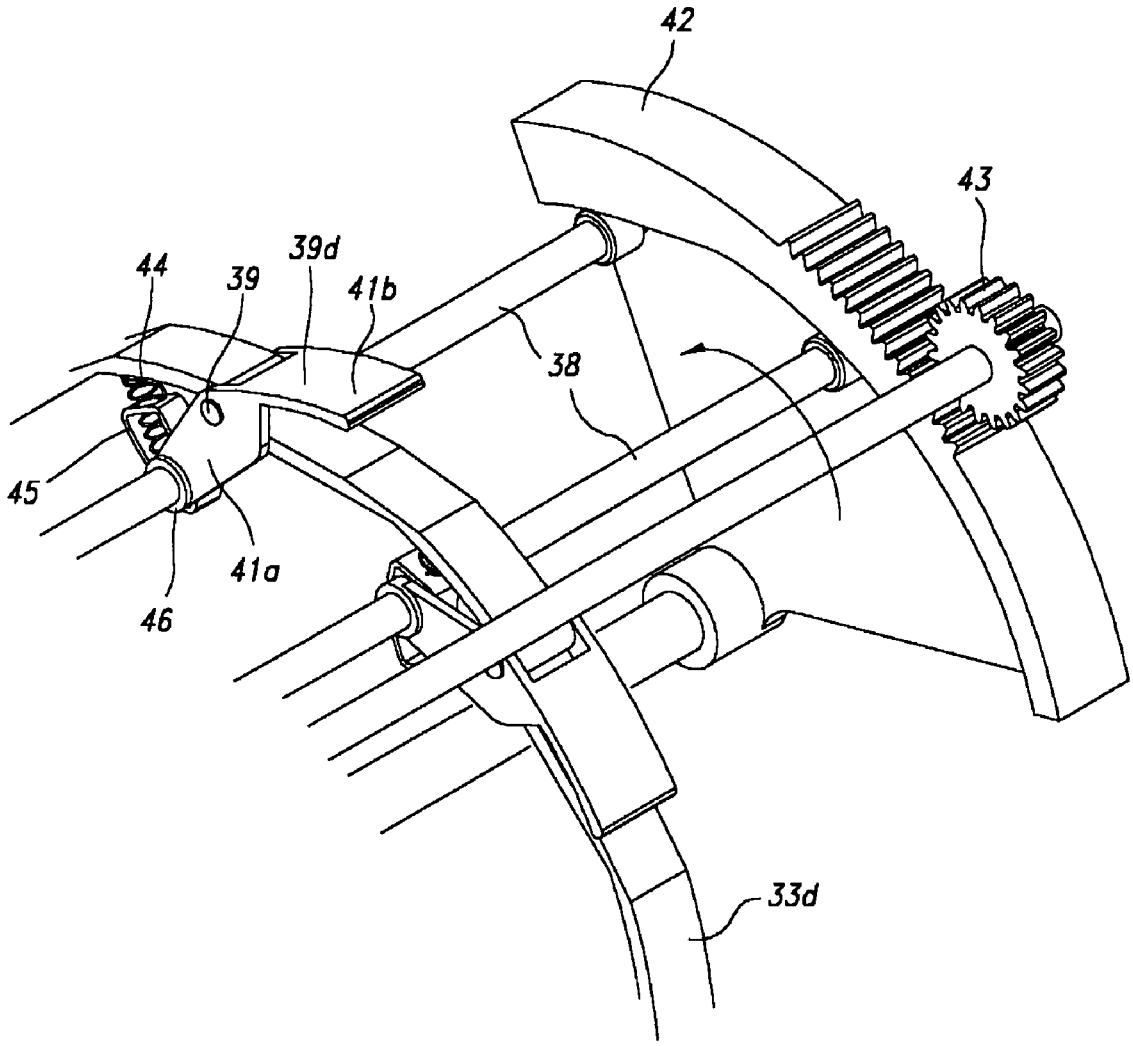
FIG. 7 illustrates the operation of a sheet feeding grip in a sheet feeding apparatus according to the present invention.

The sheet feeding rip 36*d* shown in FIG. 7 includes a first extension 41*a* , a second extension 41*b* , and a fixed shaft 39 interposed between the first extension and the second extension and rotatably fixed to the support ring 33*d*.

The first extension 41*a* of the sheet feeding grip 36*d* is fixed by a spring 44 to act tension on the outside of the support ring along with a flexible shaft 38. The flexible shaft 38 is fixed between the support ring 33*d* and the central shaft 35. Once the spring 44 is fixed on the first extension as above and pulls the first extension toward the support ring 33*d*, the second extension 41*b* is closely adhered to the outside of the support ring 33*d* so far as load is not externally given to the flexible shaft 38. Thus, the second extension 41*b* is maintained in contact with the outside of the support ring.

The spring 44 is provided with a spring support 45 and thus is fixed to the flexible shaft 38 and the first extension 41*a*. The spring support 45 is structured that a cam roller 46 can be moved within the spring support. Also, the spring support 45 serves to reduce fatigue of the spring caused by repeated tension.

Once the support ring 33*d* is rotated toward an arrow around the central shaft 35 in a state that the second extension 41*b* is closely adhered to the support ring 33*d*, the second extension 41*b* is lifted outside the support ring 33*d* around the fixed shaft 39 when the flexible shaft 38 fixed to the first extension 41*a* is in contact with a predetermined position of a sheet feeding grip controller (i.e., cam 42).

Once the support ring 33*d* continues to rotate in a state that the second extension 41*b* is lifted by action of the flexible shaft as above, the flexible shaft 38 is released from the cam 42 and returns to the original position. Once the flexible shaft 38 returns to the original position, the spring 44 pulls the first extension 41*a* to the support ring 34*d*. Therefore, the second extension 41*b* lifted outside the support ring returns to the original position and is maintained in closely contact with the outside of the support ring 33*d*.

Once the sheets are moved through the sheet moving path 106 at the time when the second extension 41*b* is lifted, the end of the sheets is gripped by the second extension. The cam 42 that serves as the sheet feeding grip controller is rotatably provided at a predetermined angle around the central shaft 35 so as to control the position in contact with the flexible shaft 38.

A cam gear 43 is provided to control the contact position between the cam 42 and the flexible shaft 38, and the position of the cam 42 engaged with the cam gear is controlled by rotation of the cam gear.

Meanwhile, as will be aware of it from FIG. 6, the sheet moving path 6 and the plurality of sheet ejection paths 107 and 108 are provided on the outside of the sheet feeding drum 105.

A fork flip 110 is provided in the sheet ejection path 107 so that the sheets are ejected to the sheet ejection path 107 or the sheet ejection path 108 by its operation. A sheet buffer is provided in the sheet ejection path 108 to buffer the sheets moving through the sheet feeding drum.

Figure 8:
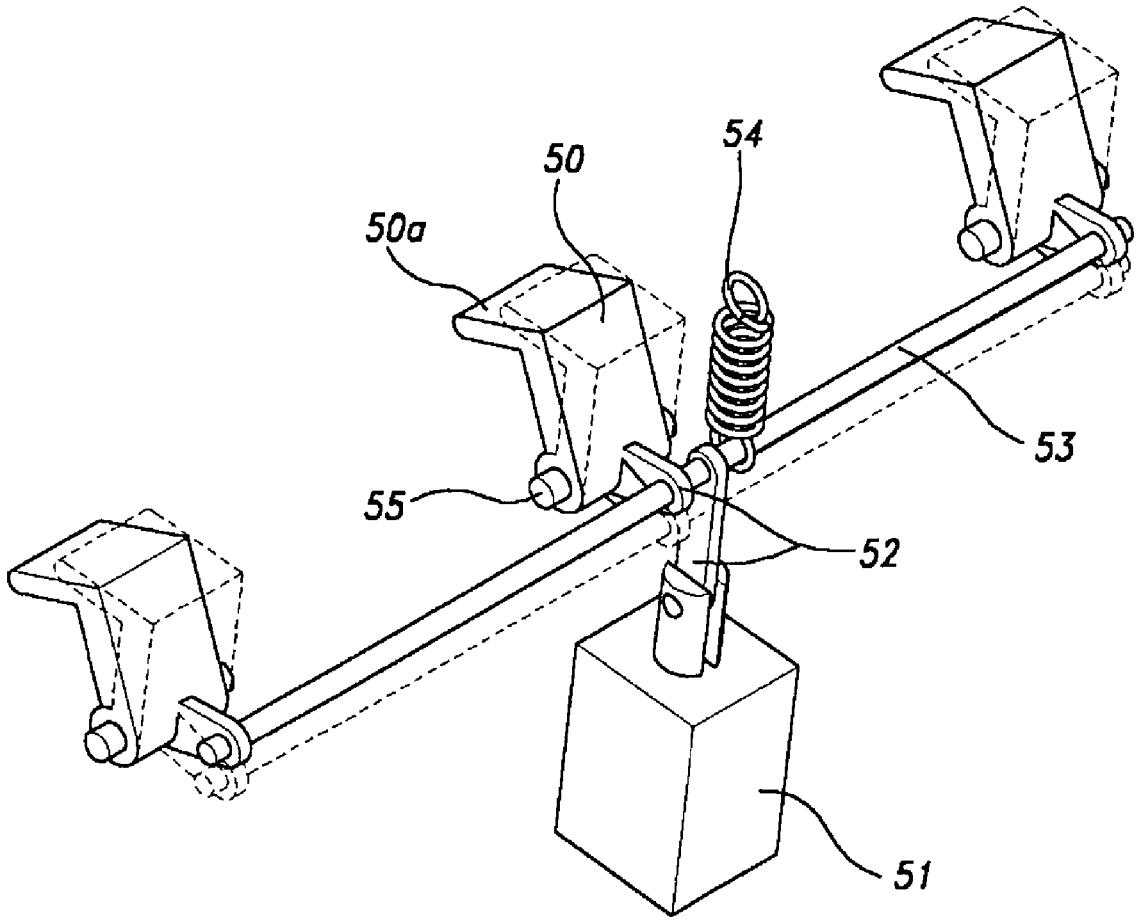
FIG. 8 illustrates the operation of an end fence in a sheet feeding apparatus according to the present invention.

The structure and operation of the sheet buffer will be described with reference to FIG. 8.

The sheet buffer includes an end fence 50, a solenoid 51, an end fence link 52 operating the end fence 50 by driving the solenoid 51, a link support shaft 53 supporting the link, and a spring 54 elastically supporting the link support shaft 53.

A protrusion 50*a* of the end fence 50 is moved to the inside or the outside of the sheet feeding drum 105 around a rotational shaft 55 by the operation of the solenoid. Once the protrusion 50*a* is moved to the central shaft 35 through the support ring or a portion between the sheet feeding rollers, the sheets moving along the outside of the sheet feeding drum are hung in the protrusion 50*a* of the end fence 50 and buffered. On the contrary, once the protrusion 50*a* is moved to the direction opposite to the central shaft of the sheet feeding drum (the, outside of the support ring or the rollers), the sheets are not buffered but ejected out through the sheet ejection path 108.

In the aforementioned sheet feeding apparatus of the present invention, the sheet P1 is gripped by the sheet feeding grips 36*a*, 36*b*, 36*c* and 36*d* and moved along the outside of the sheet feeding drum 105 as will be aware of it from FIG. 4.

The sheet moving along the outside of the sheet feeding drum is moved along the rotational direction of the support rings 33*a*, 33*b*, 33*c* and 33*d* and the sheet feeding rollers 34*a*, 34*b*, 34*c* and 34*d*. The idle rollers 37*a*, 37*b*, 37*c*, and 37*d* provided in the sheet feeding rollers serve to facilitate movement of the sheet and are rotated in a direction opposite to the rotational direction of the sheet feeding rollers.

The sheet P1 is buffered by the end fence 50 constituting the sheet buffer, and the sheet P2 following the sheet P1 is moved to the bottom at the rear end of the sheet P1 in a state that the sheet feeding grips grip the sheet P2. The sheet P2 is then buffered by the end fence 50. The sheet feeding grips serve to guide the sheets P1, P2 and P3 to be exactly buffered in order.

As an example, the operation of buffering and ejecting small sized sheets will be described with reference to FIG. 9 to FIG. 14.

Figure 9:
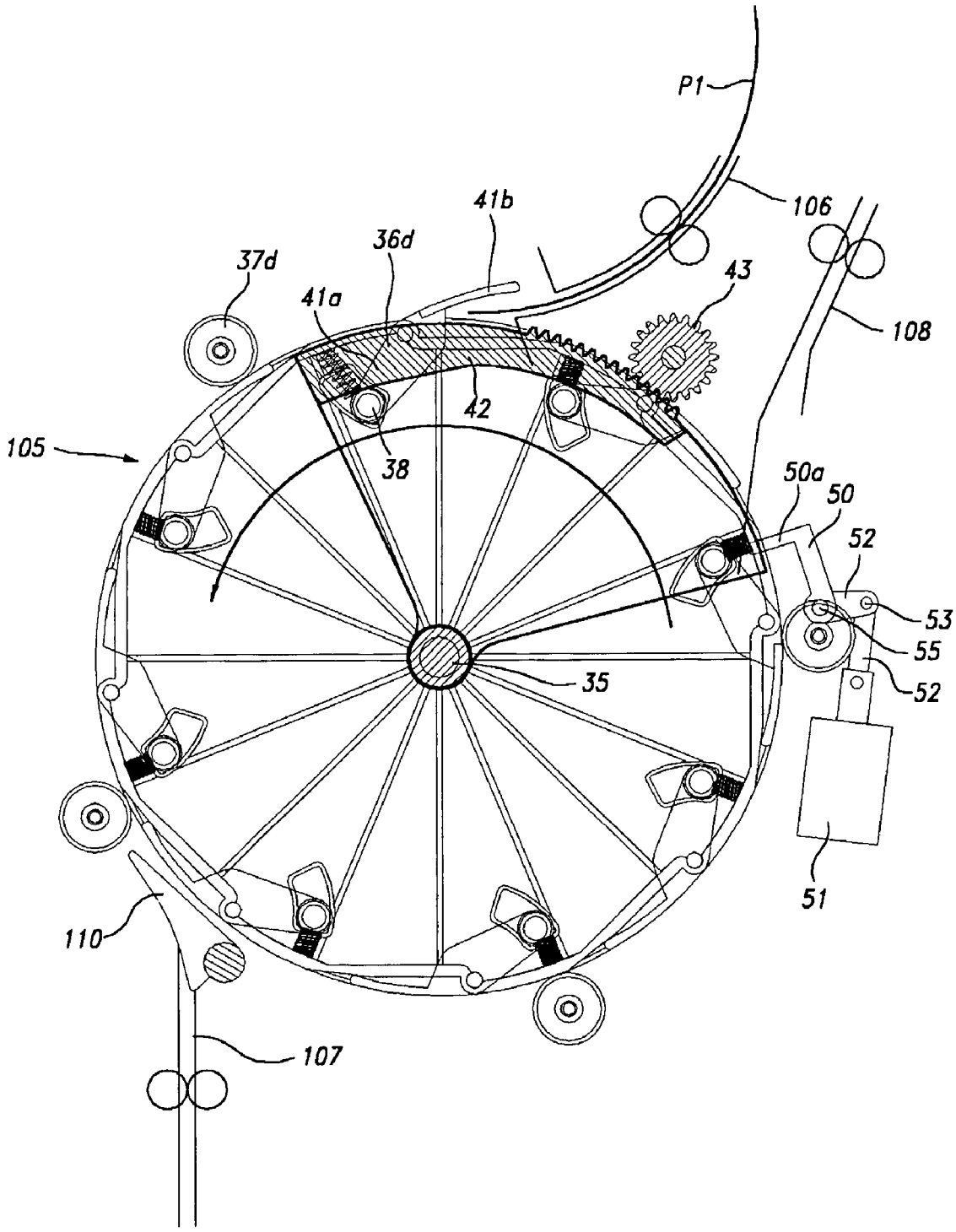
FIGS. 9 to 14 illustrate the operation steps of buffering small sized sheets in a sheet feeding apparatus according to the present invention.

First, as shown in FIG. 9, the sheet P1 is moved through the sheet moving path 106 and is hung in the second extension 41*b* of the sheet feeding grip 36*d* opened by the cam 42.

Figure 10:
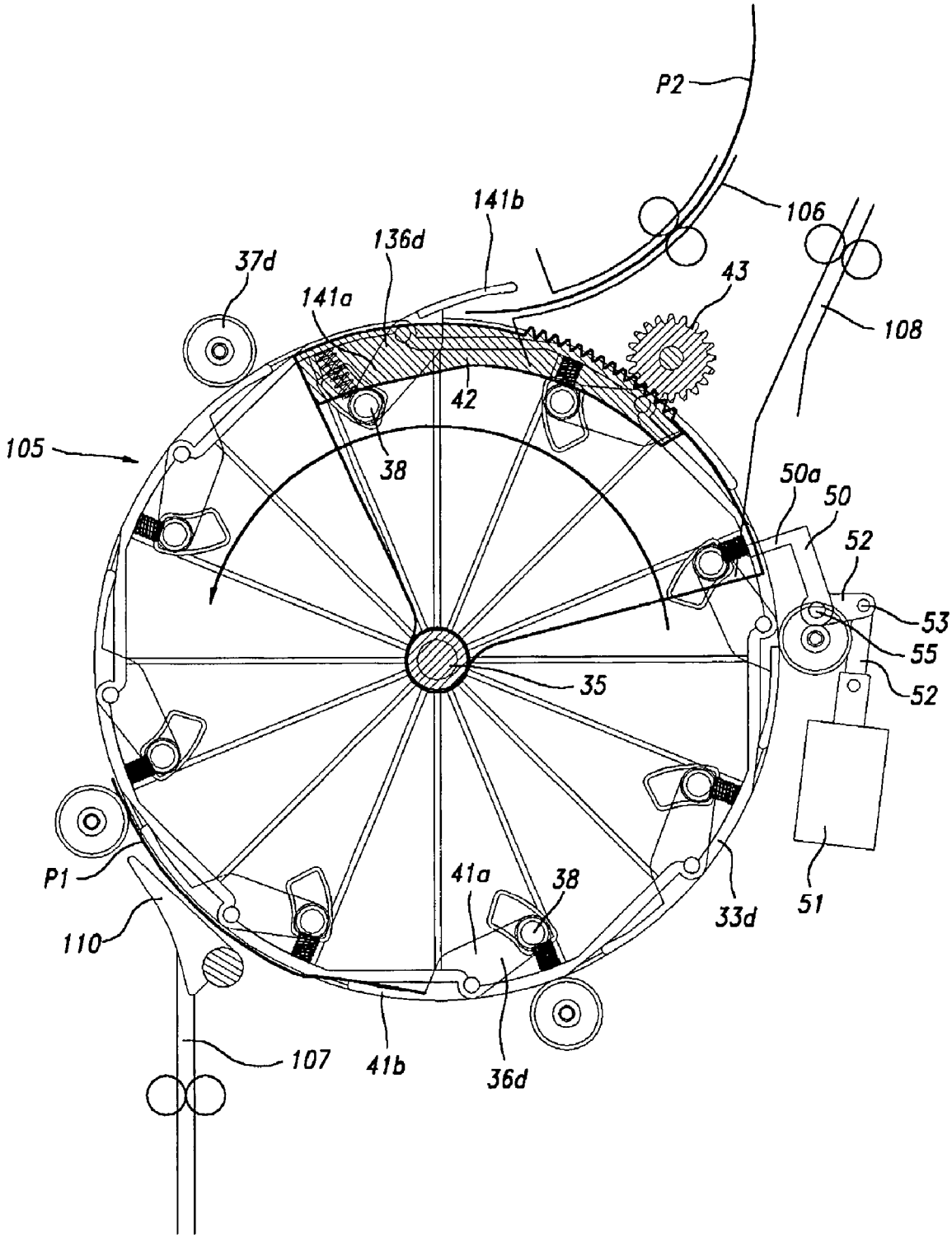

As shown in FIG. 10, the sheet P2 is moved through the sheet moving path 106 and is hung in the second extension 141*b* of the sheet feeding grip 136*d* opened by the cam 42. The sheet feeding grip 36*d* released from the cam 42 is moved along the outside of the sheet feeding drum in a state that it grips the end of the sheet P1 after the second extension 41*b* is closed.

Figure 11:
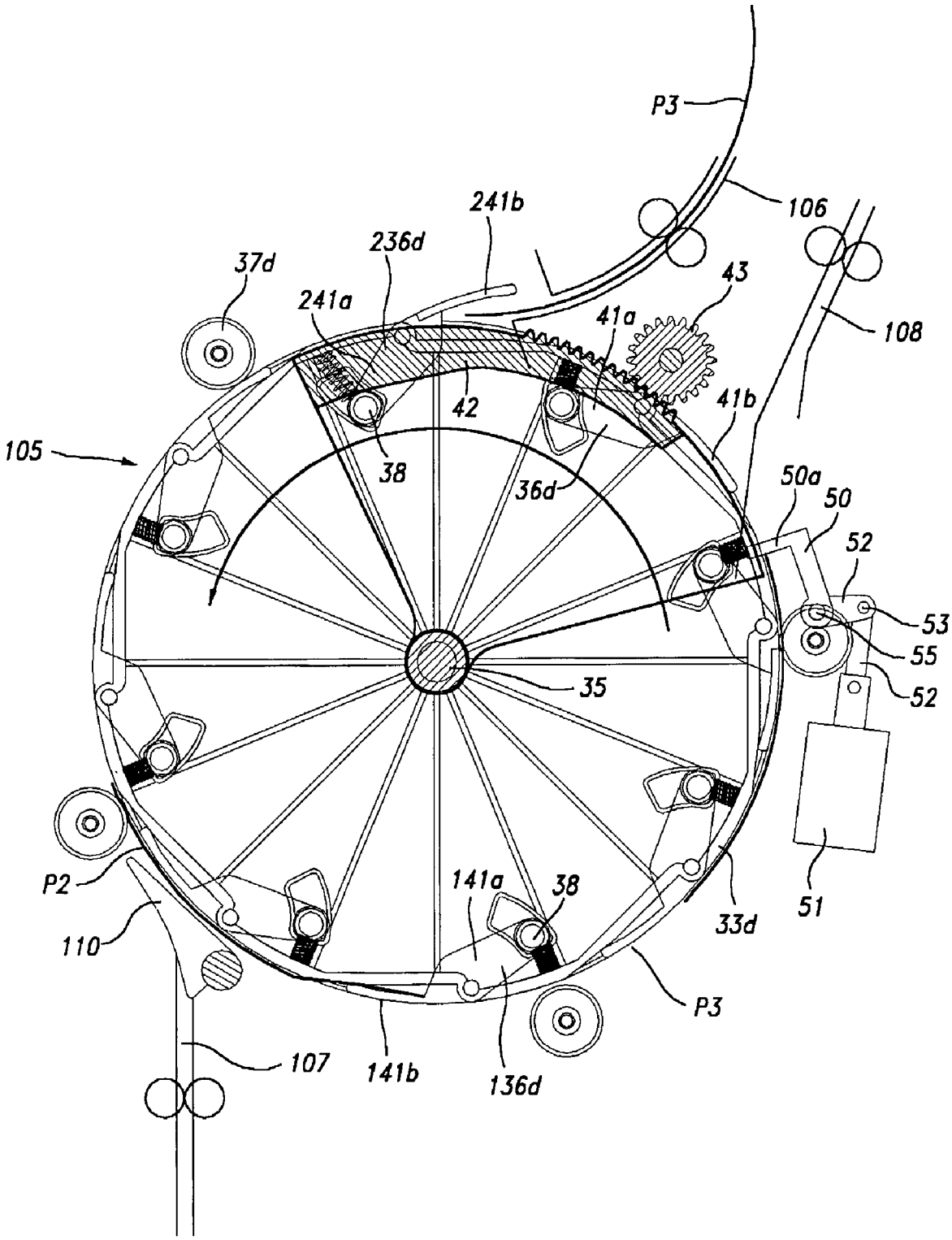

Subsequently, as shown in FIG. 11, the sheet P3 is moved through the sheet moving path 106 and is hung in the second extension 241*b* of the sheet feeding grip 236*d* opened by the cam 42. The sheet feeding grip 136*d* released from the cam 42 is moved along the outside of the sheet feeding drum in a state that it grips the end of the sheet P2 after the second extension 141*b* is closed. The sheet P1 followed by the second sheet P2 is hung in the protrusion 50*a* of the end fence 50 and thus released from the second extension 41*b* of the sheet feeding grip 36*d*. The sheet P1 is then buffered, and the sheet feeding grip 36*d* is released from the sheet ejection path 108.

The sheets are buffered as above after they are exactly stacked in order.

Figure 12:
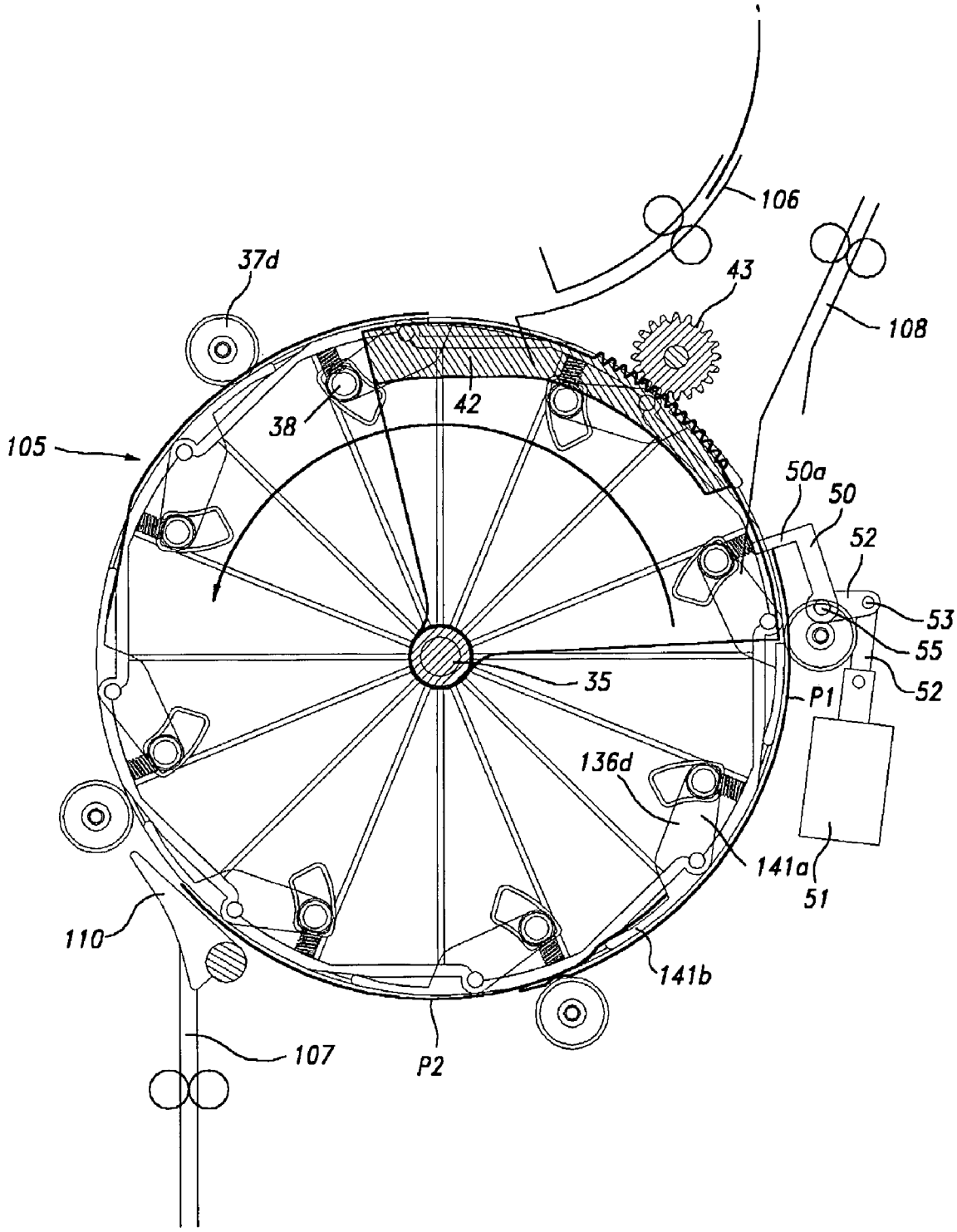

The step of stacking the sheets in order will be described with reference to FIG. 12.

When the sheet P2 is moved to the end of the sheet P1 in a state that it is gripped by the sheet feeding grip 136*d* after the sheet P1 is buffered, the second extension 141*b* of the sheet feeding grip gripping the sheet P2 is maintained closely adhered to the outside of the support ring 33*d*. Therefore, the second extension 141*d* is moved to the bottom at the rear end of the sheet P1 so as to guide the sheet P2 to be stacked below the sheet P1. In other words, the sheets moved later are buffered on the portion close to the support ring 33*d*.

Figure 13:
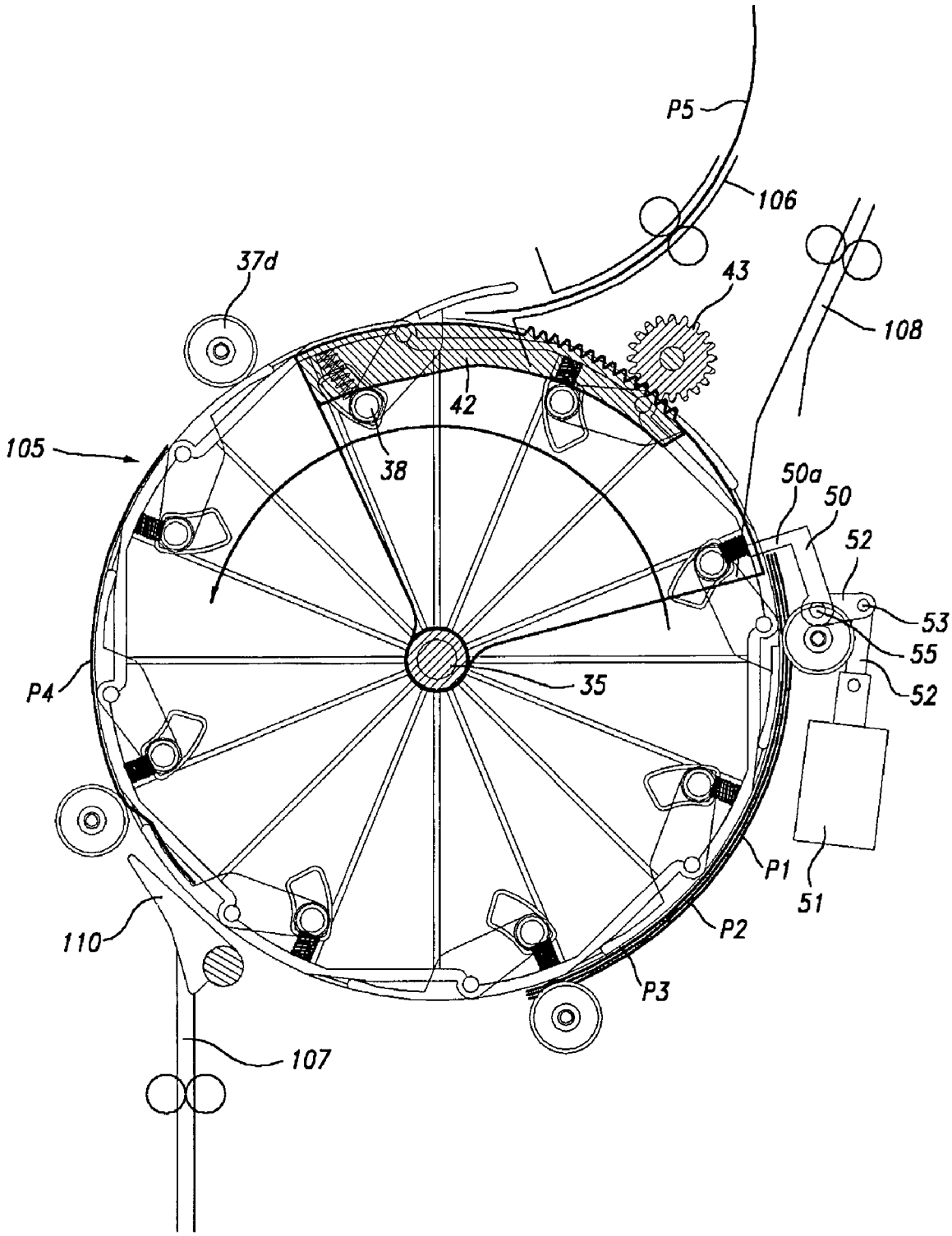
Figure 14:
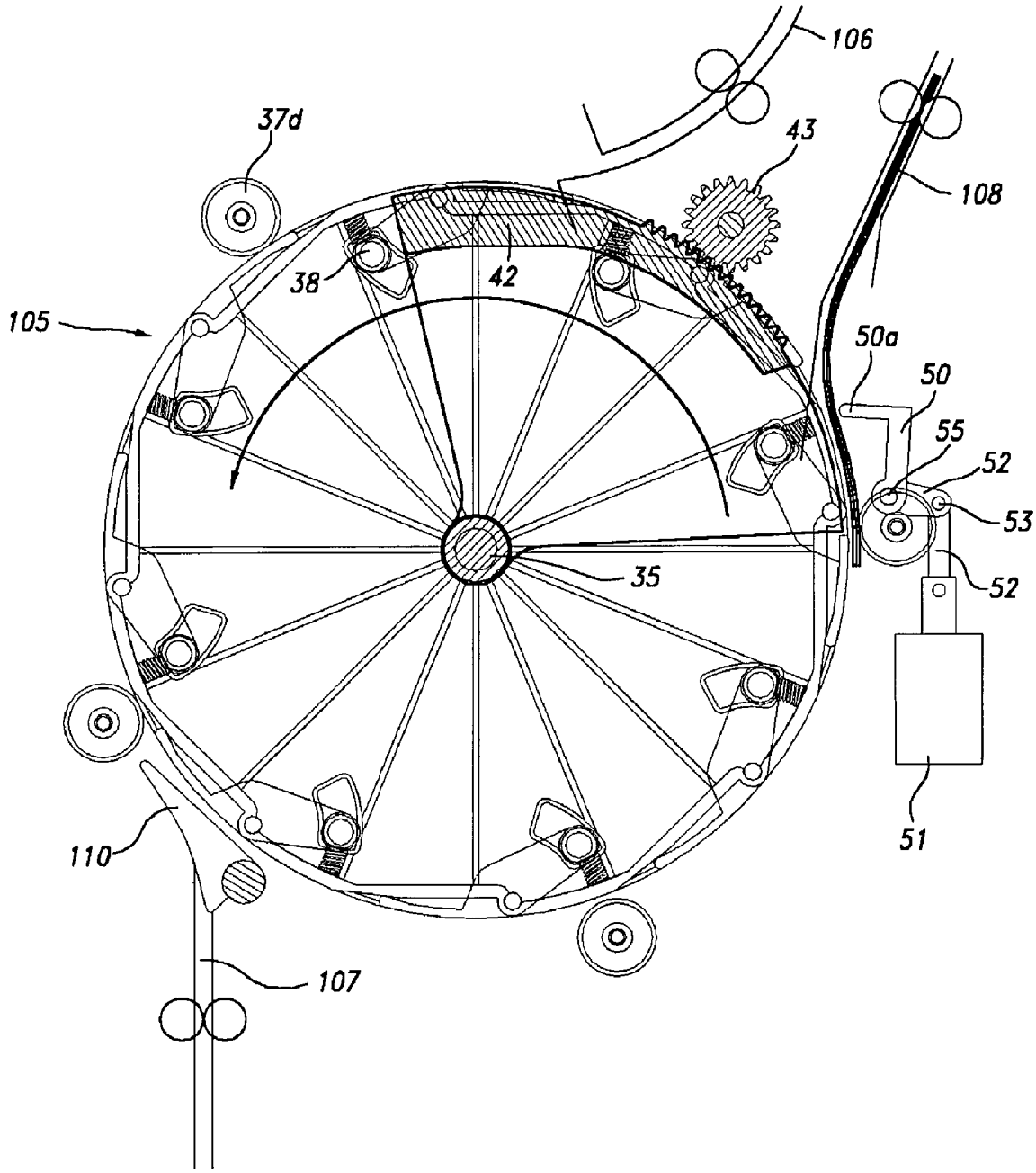

Once a predetermined number of sheets are buffered as shown in FIG. 13, the end fence 50 is opened as shown in FIG. 14 so that the buffered sheets are ejected to a sheet finisher (not shown) through the sheet ejection path 108.

New sheets are moved through the sheet moving path 106 while the buffered sheets are ejected to the sheet finisher.

The first sheet of the buffered sheets may not be gripped by the sheet feeding grip. However, the other sheets should be moved in a state that they are gripped by the sheet feeding grip, so as not to change the buffering order of the sheets. Therefore, the last sheet of the buffered sheets is moved in a state that it is gripped by the sheet feeding grip, and the first sheet of the following buffered sheets (following sheet lot) may be controlled in a state that the sheet feeding grip does not work.

The step of buffering large sized sheets per two will be described with reference to FIG. 15 and FIG. 16.

Figure 15:
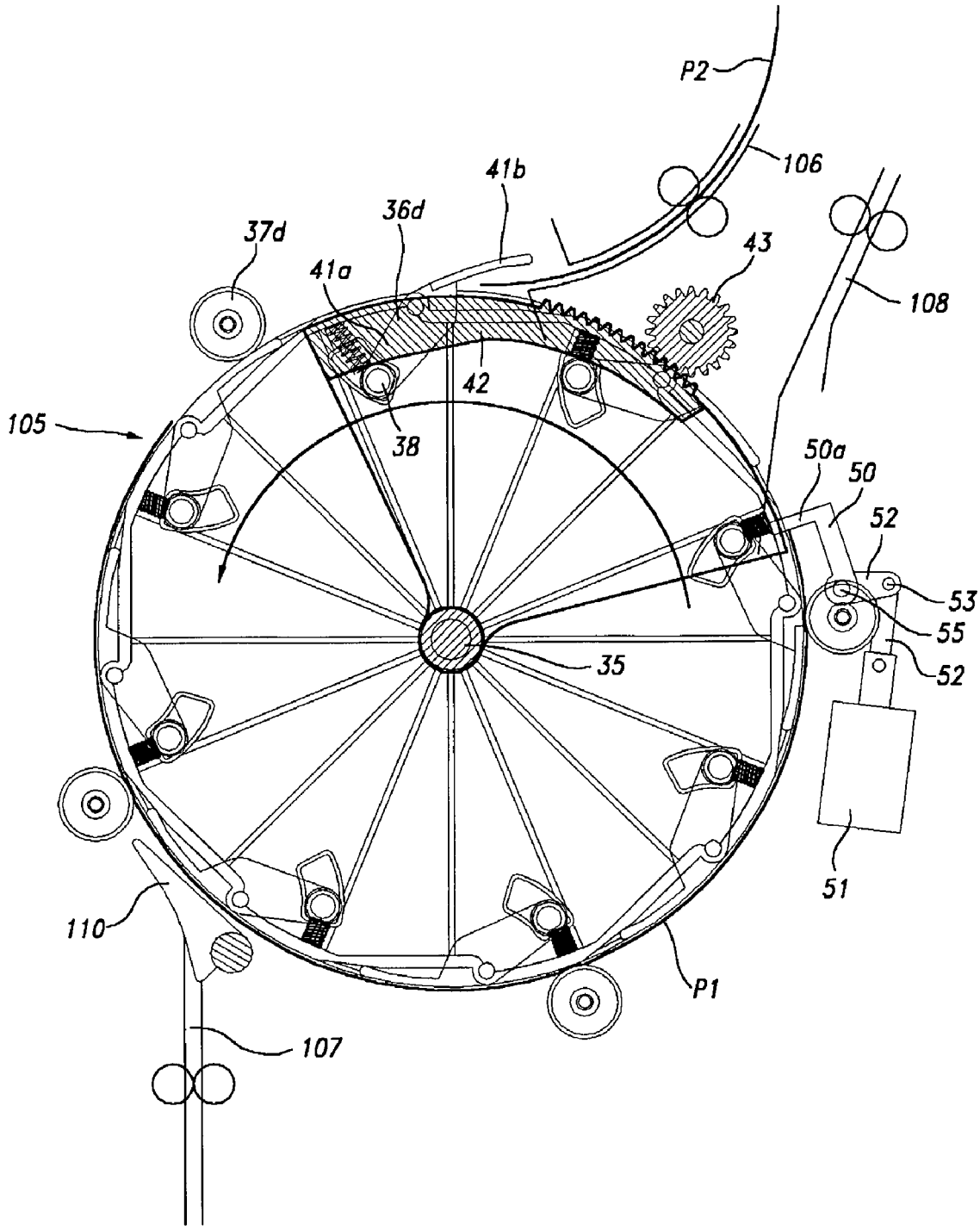
FIGS. 15 and 16 illustrate the operation steps of buffering large sized sheets in a sheet feeding apparatus according to the present invention.

As shown in FIG. 15, the second sheet P2 is moved in a state that it is gripped by the second extension 31*b* of the sheet feeding grip 36*d* after the first sheet P1 is buffered. The first sheet P3 of the following buffered sheets is not gripped by failing to work the sheet feeding grip 236*d* at the inlet of the sheet moving path 106. The operation of the sheet feeding grip 236*d* is controlled by controlling the position of the cam 42 using the cam gear 43.

Figure 16:
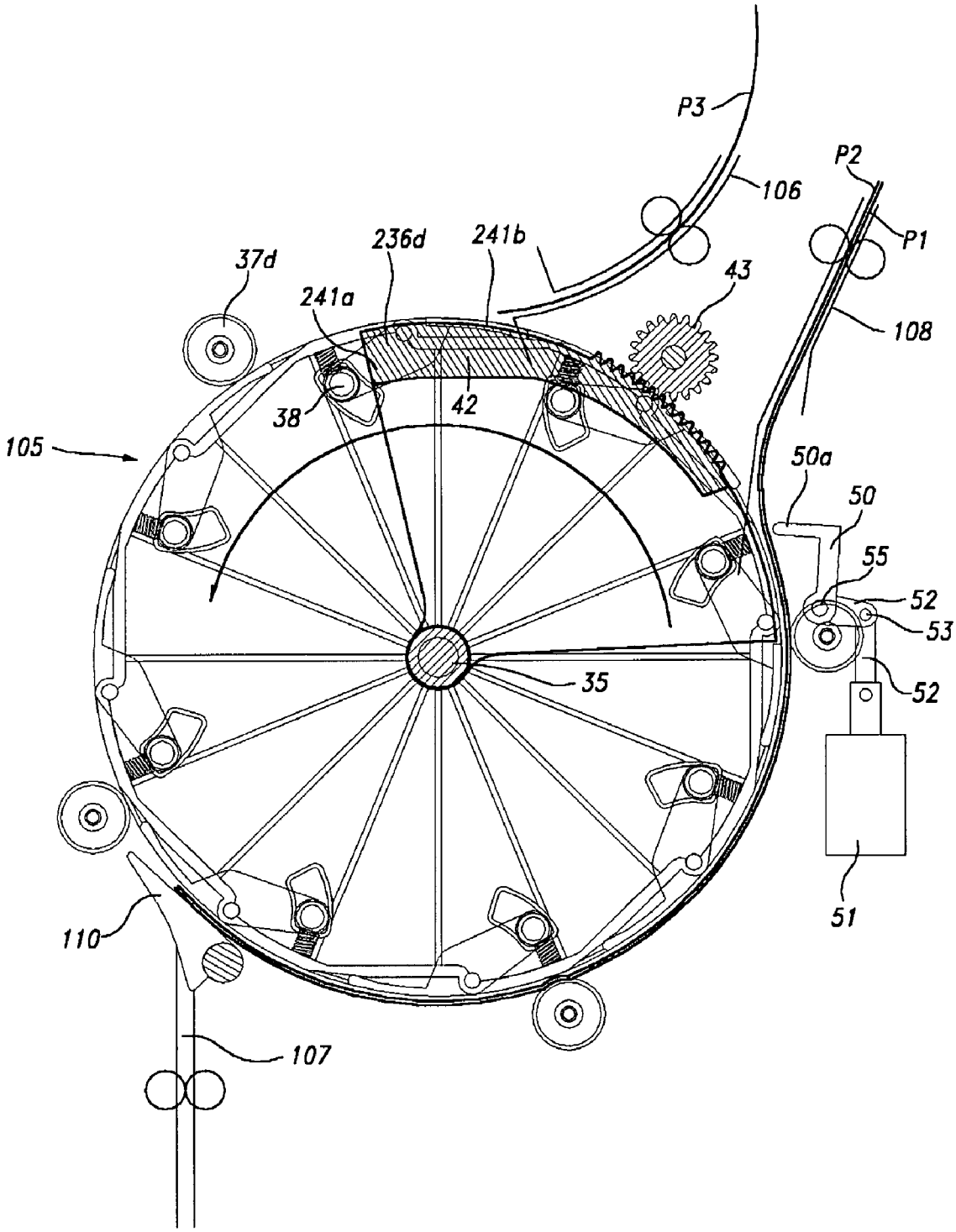

Unlike FIG. 15, since the position of the cam 42 is inclined to the right side in FIG. 16, the flexible shaft 38 controlling the operation of the sheet feeding grip 236*d* in the vicinity of the sheet moving path 106 is released from the position of the cam 42. Thus, the sheet P3 cannot be gripped by the second extension 241*b*.

Figure 17:
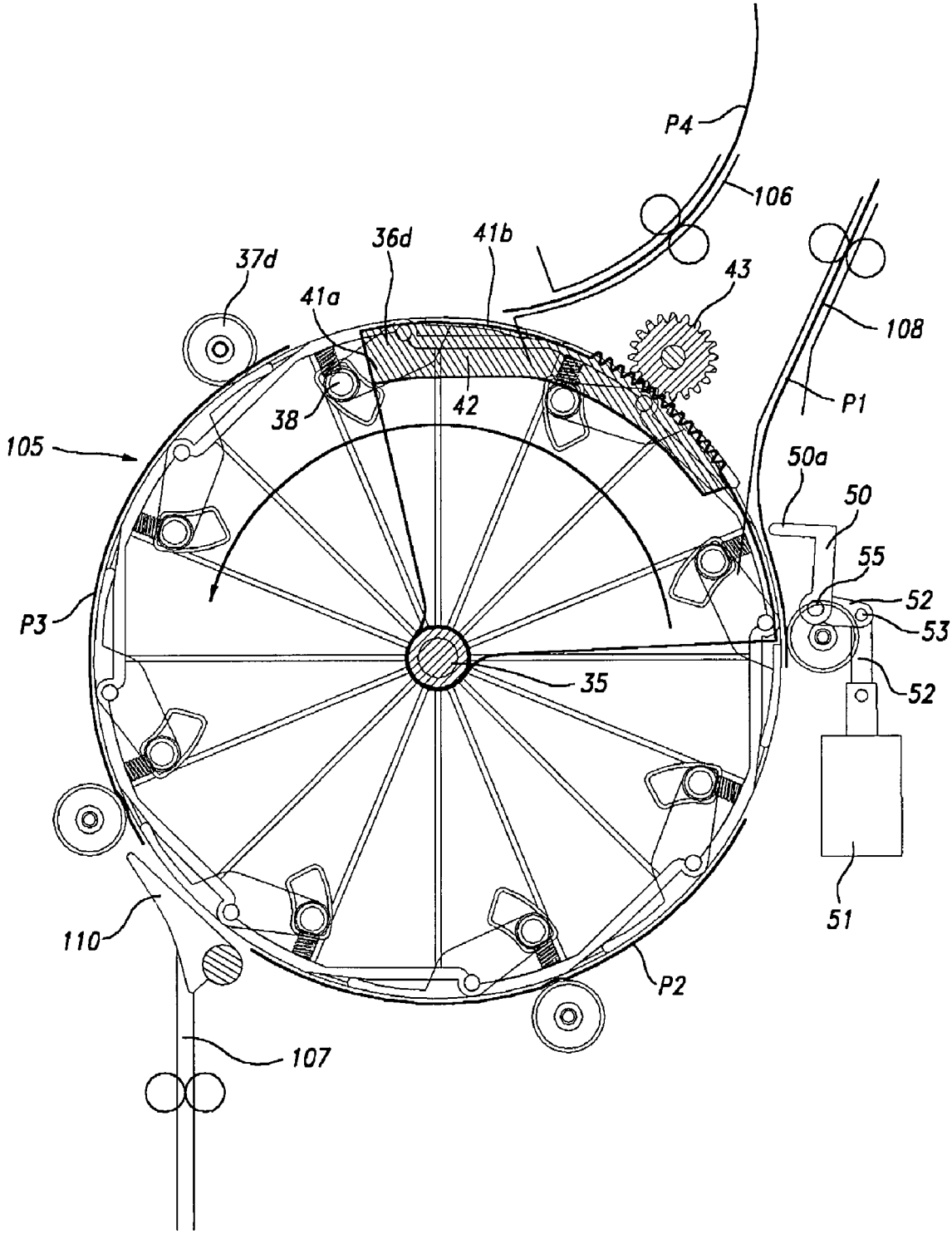
FIG. 17 illustrates a structure that sheets are directly ejected to a sheet ejection path without being buffered in a sheet feeding apparatus according to the present invention.

Meanwhile, FIG. 17 illustrates a structure that the sheets P1, P2, P3 and P4 moving through the sheet moving path 106 are directly ejected to the sheet ejection path 108 through the sheet feeding drum without being buffered.

Figure 18:
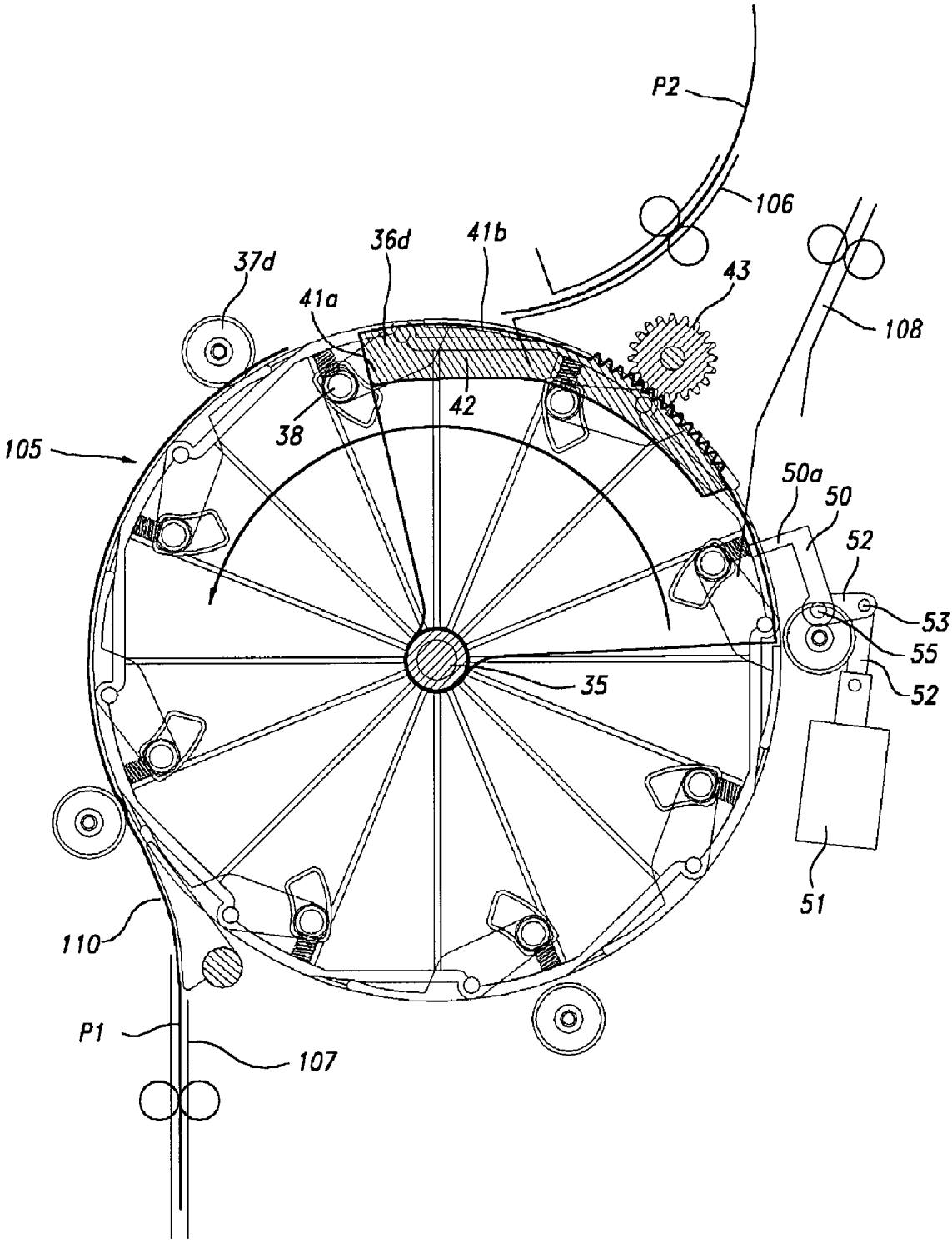
FIG. 18 illustrates a structure that a path of sheets is changed through a fork flip in a sheet feeding apparatus according to the present invention.

Once the sheets are directly ejected to the sheet ejection path without buffering operation, the second extension 41*b* of the sheet feeding grip is closed when the sheet feeding grip 36*d* is moved to the position of the sheet moving path 106. In this case, the position of the cam 42 can be controlled so that the sheets cannot be gripped by the second extension. Further, the sheets may be ejected to the sheet ejection path 107 by controlling the fork flip 110 provided in the sheet ejection path 107 as shown in FIG. 18.

What is claimed is:

1. A sheet feeding apparatus comprising:

a drum having a longitudinal, circumferential and radial direction;

at least one shaft extending in the longitudinal direction of the drum; and at least one sheet feeding grip attached to the at least one shaft, the sheet feeding grip comprising:

a first extension pivotally attached to the at least one shaft; and a second extension connected to and extending from the first extension.

a buffer proximate the drum, the buffer comprising an end fence and an actuator, wherein the buffer comprises:

a link support shaft; and a plurality of L-shaped fences attached to the link support shaft and the actuator attached to the link support shaft for moving the link support shaft to cause rotation of the fences;

wherein one end of each of the plurality of L-shaped fences is located inside the circumference of the drum when the buffer accumulates sheets.

2. The sheet feeding apparatus of claim 1, further comprising:

a spring extending between the at least one shaft and the first extension.

3. The sheet feeding apparatus of claim 1, further comprising:

a support ring extending about the drum, the support ring configured to cooperate with the sheet feeding grip to retain a sheet.

4. The sheet feeding apparatus of claim 3, further comprising:

a grip controller acting on the at least one shaft to move the second extension relative to the support ring.

5. The sheet feeding apparatus of claim 4, wherein the grip controller comprises a top surface and a bottom surface, the grip controller having a cam shape and the bottom surface acting on the at least one shaft.

6. The sheet feeding apparatus of claim 5, further comprising:

a position controller acting upon the top surface of the grip controller to move the grip controller in a circumferential direction.

7. The sheet feeding apparatus of claim 6, wherein the position controller is a pinion and a rack is formed on the top surface of the position controller.

* * * * *